US006315696B1

(12) United States Patent
Garrioch

(10) Patent No.: US 6,315,696 B1
(45) **Date of Patent: *Nov. 13, 2001**

(54) LIQUID IMMERSION THERAPEUTIC DEVICE

(75) Inventor: Neil H. G. Garrioch, Brooklyn, NY (US)

(73) Assignee: Robin Goldstein, San Jose, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/015,669

(22) Filed: Jan. 29, 1998

Related U.S. Application Data

(60) Provisional application No. 60/036,664, filed on Jan. 30, 1997.

(51) Int. Cl.[7] ..... A63B 23/16
(52) U.S. Cl. ..... 482/49; 482/44
(58) Field of Search ..... 607/111, 112, 607/114, 91, 108; 2/159, 160, 162; 482/44, 45, 48–50; 294/25; 601/15, 23, 33, 40, 134, 135, 136

(56) References Cited

U.S. PATENT DOCUMENTS

| | | | | |
|---|---|---|---|---|
| 1,549,710 | * | 8/1925 | Campbell | 482/49 |
| 1,740,624 | * | 12/1929 | Peel | 601/15 |
| 2,949,914 | * | 8/1960 | Waldrum | 607/111 |
| 3,265,389 | * | 8/1966 | Carlson | 482/49 |
| 3,977,396 | * | 8/1976 | Cartier | 601/15 |
| 4,040,619 | * | 8/1977 | Landi | 482/49 |
| 4,275,812 | * | 6/1981 | Poncy et al. | 2/159 |
| 4,329,997 | * | 5/1982 | De Yampert et al. | 607/111 |
| 4,513,736 | * | 4/1985 | Thurber | 607/111 |
| 4,573,447 | * | 3/1986 | Thrash et al. | 607/111 |
| 4,630,596 | * | 12/1986 | Hales et al. | 607/112 |
| 4,813,405 | * | 3/1989 | Filip | 601/134 |
| 4,849,226 | * | 7/1989 | Gale | 424/448 |
| 4,929,211 | * | 5/1990 | Resnick et al. | 446/14 |
| 5,241,958 | * | 9/1993 | Noeldner | 607/86 |
| 5,319,021 | * | 6/1994 | Christy | 524/857 |
| 5,688,208 | * | 11/1997 | Plemmons | 482/44 |
| 5,690,586 | * | 11/1997 | Wilhelm | 482/49 |
| 5,704,670 | * | 1/1998 | Surplus | 294/25 |
| 5,716,303 | * | 2/1998 | Scatterday | 482/49 |
| 5,890,999 | * | 4/1999 | Kilani | 482/44 |

* cited by examiner

*Primary Examiner*—Justine R. Yu
(74) *Attorney, Agent, or Firm*—Robin Goldstein

(57) ABSTRACT

A therapeutic device is provided for use in the treatment and/or rehabilitation of injuries to bodily extremities, such as the hands or feet. In the device a capsule or chamber is provided which is at least partially filled with a Newtonian or non-Newtonian liquid. An area approximating the shape of the extremity to under therapy, such as a hand, is formed and made an integral part of the capsule such that the extremity undergoing therapy may be inserted to move freely within the liquid physically coming into contact with the liquid. In one embodiment the capsule is molded from a single piece of transparent rubber with a fluid chamber formed at one end and a glove-like area formed at the other. The fluid chamber is filled with a liquid, such as medical grade silicone or organic polymer liquid, and then the glove-like area inverted to be located within the outer walls of the capsule. A user may then insert his or her hand into the chamber, by way of the glove, and undergo therapy or exercise within the environment of the liquid without actually coming into contact with the liquid. Variations of the invention permit the hand to be heated or cooled, either from within or radiantly. In addition, by making all materials transparent or translucent, it is possible for the patient or therapist to observe the hand undergoing therapy, thereby ensuring maximum effect without introducing the danger or causing additional damage.

16 Claims, 4 Drawing Sheets

LIQUID IMMERSION THERAPEUTIC DEVICE

Inventor claims the benefit under 35 U.S.C. 119(e) of United States Provisional Patent Application No. 60/036,664 filed on Jan. 30, 1997.

This invention relates in general to physical therapy devices, and in particular to therapeutic devices utilizing liquids into which bodily extremities, such as the hands or feet, may be immersed in order to obtain the desired therapeutic effect. For the purposes of this invention, the term "liquid" is given its broadest possible meaning, and is intended to include, by way of example, pure Newtonian liquids as well as non-Newtonian liquids, such as gels or visco-elastic fluids.

BACKGROUND OF THE INVENTION

In the fields of physical therapy, sports medicine, hand surgery, home and gymnasium relaxation therapy and other related fields there is a demonstrable need for analeptic devices and environments for the exercise, temperature control and stimulation of injured or otherwise physically compromised body extremities. This is particularly true in connection with therapy directed to the hands. It is well known that in the treatment of and recuperation from manual injury, post-surgical recovery or disease, it is extremely important that the hand be provided with restorative and invigorating exercise in an environment that will promote recovery. Many different medical conditions require such exercise and stimulation, including: manual injury, surgical intervention, chronic joint disease and inflammation, carpal tunnel syndrome, vascular disorders, neurological disorders, and exercise fatigue to name a few. Optimal recovery requires the correct level of exercise and stimulation, which is usually, but not necessarily, carried out with medical supervision. Often, this exercise and stimulation is easier to achieve with the help of supplemental equipment. However, a survey of existing equipment and environments shows that each have specific drawbacks and inadequacies.

For example, in one kind of therapy, the hand or other extremity to be treated is immersed in liquid wax, removed and then re-immersed a number of times in order to build up a layer of hot material which resists passive movement. This therapy is known to have brought some benefits to some patients. However, the wax is frequently too hot for comfort, especially in light of the inherent tenderness of the region to be treated. In addition, wax also tends to provide too much resistance to movement, resulting in a non-therapeutic experience. Another drawback of wax is that visual monitoring of movement is generally impaired due to the translucency or opacity of the wax. And finally, for some patients the removal of the hardened wax at the end of the therapy session may be uncomfortable, painful, or even dangerous.

Another technique intended for the treatment and rehabilitation of specific tendon, joint or bone injuries, or to ameliorate the effects of surgery, involves the surface attachment of elastic elements between the tips of injured fingers and the forearm. This technique, known as "dynamic splinting" (described in detail in "Hand Splinting" by Judith C. Wilton, WB Saunders and Company, 1997) may be used, for example, to assist in returning injured fingers to a grasping position after they have been extended under exercise. The elastic elements provide gentle resistance to the extensor (hand-opening) muscles without requiring the active contraction of the flexor (grasping) muscles. However, practice has shown that it is difficult to devise equipment that provides the same kind of gentle resistance in the opposite direction, ie, a technique for applying resistance to the flexor (grasping) muscles of the hand which then returns the fingers to an extended position, without the active use of the extensor (hand-opening) muscles. In other words, experience has shown that this kind of therapy works well in one direction but not the other. In addition, this kind of therapeutic technique is not well suited for use in providing equal resistance to each individual digit regardless of it's direction of movement.

In a similar vein, there are a number of products on the market which provide for the unidirectional exercise of the hand, usually in a grasping action. Squeezable rubber balls, certain kinds of putty, and bead-filled pouches may all be purchased as therapeutic hand devices. However, each of these devices suffer the same limitation of exercising the grasping muscles much more than the extending muscles.

In addition to therapy focused on the exercise of specific muscles in open air, therapy techniques involving the direct immersion of a body extremity in water or in a viscous liquid are also sometimes practiced for their therapeutic effects. Such therapies have the advantage of allowing temperature control, in addition to providing therapeutic resistance. However, one drawback of such therapies is that the water or other liquid used is often not viscous enough to provide optimal, or even useful, resistance to movement. An additional drawback is that in this kind of therapy the liquid employed needs to come into direct contact with the skin of the user, which is frequently undesirable, inconvenient, and hinders portability. One solution to the direct contact problem is to provide flexible, webbed rubber gloves as a barrier between the user and the liquid. Unfortunately, in practice these kinds of gloves do not allow easy and universal movement of delicate or damaged digits, and only provide the fluid resistance of the water in which they are used.

Therefore, as can be seen from the above discussion, a first significant limitation of the prior art is that physical therapy, relaxation and recreational therapy equipment is often cumbersome and impractical for use in the hospital bed, the work-place, during travel, or in domestic settings.

Another limitation of the prior art is that very often it is desirable to practice different kinds of physical therapy in sequence or even simultaneously. For example, a manual exercise might then be followed by an electro-stimulation therapy, which may then be followed by a hot or cold immersion therapy. As is easily understood, the sequential and/or simultaneous implementation of all three techniques is not generally possible, despite the knowledge that in some instances, such enhanced therapeutic techniques can provide enhanced beneficial results.

Turning, next, to the enclosed liquid component of the instant invention, while the above described needs and techniques are directed to the provision of precisely controlled therapeutic resistance, it is also known that it is highly beneficial to provide padding or some other shock absorbing mechanism in conjunction with the application of therapy or exercise. By way of example, it is known that in order to protect against impact during exercise or movement various visco-elastic pads and orthotics may be used to provide a soft surface against which to press a bodily extremity. However, while such padding may utilize elements found in common with the invention, these elements are not used in an immersion manner, and do not provide the desired therapeutic results.

For example, while it is known that liquid-filled flexible products exist which are used in various applications such as cold-compress packs for various parts of the body, soft shoe insoles and orthotics, or other pads; as noted, these devices are used as external application devices rather than an integral part of an immersion chamber, and do not permit (nor even offer as desirable) a way to allow the free and separate movement of the digits within the liquid, for example.

In addition, while it is also known that in the field of prosthetics there are also products employing liquid or gel filled flexible capsules and sockets to provide a more comfortable protective surface for damaged or surgically altered extremities, these products are prosthetic interfaces and do not provide a liquid environment in which the digits or extremities may move universally through the liquid, and against the fluid resistance of that liquid.

Therefore, regardless of the merits and advantages of the existing therapies and devices mentioned above, none of them achieves all of the purposes of the physical therapy immersion device of the present invention.

Accordingly it has been determined that a need exists for devices which provide many types of gentle exercise and stimulation for body extremities such as the hands, which are easy to use, may be reused, provide a comfortable, safe, washable, portable, stimulating and restorative environment for physical therapy or relaxation, and which can permit the simultaneous use of multiple therapeutic agents (exercise, thermal stimulation, light therapy, ultrasound therapy, electro-stimulation, and clear visibility).

SUMMARY OF THE INVENTION

The main object of the present invention is to provide a device for physical therapy for bodily extremities, especially the hands, which can be used to provide a comfortable, safe, washable, portable, stimulating and restorative environment for exercise or relaxation or the relief of pain. It is noted that although the instant invention is designed to be used in a therapeutic environment, it is not designed to be used primarily as a prosthetic device, nor does it function in the same way as a traditional prosthetic device.

It is a further object of the present invention to provide a therapeutic environment which is capable of simultaneously supporting multiple therapeutic agents including, but not limited to, any or all of the following: thermal stimulation, exercise, electro-stimulation, ultrasound therapy, light therapy, and the ability to provide clear visibility of the extremity being treated.

These objects, and others that will become apparent in the following description, are achieved in the present invention by providing a transparent or translucent closed capsule of specific shape and size constructed from a soft, flexible material such as silicone rubber or organic polymer into which a viscous, gelatinous, or visco-elastic liquid such as silicone liquid or similar organic polymer liquid has been sealed and/or contained.

The enclosed flexible capsule is, generally speaking, anatomically shaped in such a way that a person may introduce his or her hand (or other bodily extremity) into the whole assembly such that the hand is entirely or almost entirely enclosed within the mass of the assembly. In one embodiment the capsule is shaped in such a way that once inside, the hand and fingers can all move relatively freely subject to the viscous or visco-elastic resistance provided by the liquid and by the layer of flexible capsule material interposed between the hand and the liquid. The capsule material, which may be composed of one or more layers, protects the hand from direct contact with the liquid contents. Such protection from direct contact is desirable since silicone liquid filled silicone capsules have proven, in certain cases, to be inadequate as bodily implants due to the bio-incompatibility of silicone with the body's interior for extended periods. Such incompatibility does not exclude silicone from specific external use however, such as the instant invention, where its various physical properties may be of great value.

As will be more fully discussed, an important element of the invention is the viscosity or visco-elasticity of the liquid contained within the device. When the user's hand is immersed in the device (that is, when a user inserts his or hand into the invention) their hand movement is restricted only by the flexible capsule, the encapsulated liquid, and the particular nature of the user's hand injury or condition. The viscosity or visco-elasticity of the liquid has a direct impact on the ease with which the hand and digits will be able to move. Greater viscosity or visco-elasticity will provide greater resistance to movement and will, therefore, provide a more rigorous exercise environment within the limits of comfort. The viscosity or visco-elasticity of the liquid provides equal resistance to movement in all directions depending on the speed with which the user moves the parts of his or her hand through the liquid. Very gentle movement permits very gentle resistance even in a "thick" liquid. This is especially helpful for serious and delicate hand injuries and disorders during the early stages of recovery. At later stages of recovery the hand movement may be more rapid, thus generating greater resistance and more vigorous exercise.

Another feature of the invention is the decrease in friction generated between the digits of the hand when immersed in the device. Using the invention, the frictional resistance occurring between the digits is much lower than it would be even in the open air, since the internal surface of the capsule is lubricated by the liquid contained within. Therefore, when the hand is immersed in the device it experiences the benefits of the lubricating qualities of the liquid without ever having to come into direct contact with it. Again, this is particularly useful in cases of especially delicate injuries or disorders of the hand, but is also important in creating a relaxing, smooth feeling tactile environment for all users. This is also important in many rehabilitative instances, and is particularly important in cases of hypersensitivity or pain management.

As noted above, several additional elements of the invention are directed to controlling the temperature of the device or immersion chamber during use. The temperature of the assembly can be controlled by the temporary immersion of the whole assembly in warm or cold water, or by other suitable means of gentle heating or refrigeration depending upon the temperature requirements of the user. The temperature of the hand undergoing treatment can be further controlled by the use of radiant heating generated by external means such as a light bulb or other infrared radiation source, if such temperature control is required while the hand is still inside the device. Using this configuration allows the user to enjoy the benefits of the physical therapy for longer periods without the need to occasionally remove his or her hand while the device, is reheated or re-cooled. Alternatively, the device may also be designed to be electrically heated if required.

Another advantage of the invention is that both the capsule and the liquid contained within may be transparent. The benefits of transparency are several. Firstly, it is easier to monitor the progress of the hand as it moves into the device, during its immersion, and during its removal from the device. This may be of great importance if supervision of delicate injuries or conditions is required, either by the user or by a supervisor. In addition, the visual supervision of the immersed hand may also be helpful if the user's hand lacks tactile sensitivity. Alternatively, if a radiant heat source is being used, transparency is especially useful since more energy will go to heating the hand and not the device. Finally, it has been shown that there is psychological value in a transparent device since it allows the user to observe progress in his or her own recovery or treatment, progress which would otherwise be obscured.

Still another feature of the invention relates to the properties of electrical conductivity. Since silicone rubber and silicone liquid can be made to be electrically conductive, using such electro-conductive silicone will permit the additional advantage of applying electro-stimulation therapy to an injured hand during its immersion in the device. Alternatively, using the instant invention similar results may also be achieved by direct attachment of electro-stimulation equipment to the hand being treated, which can then be removed at any stage of the user's physical therapy session, thereby eliminating the need to make the device electro-conductive.

Finally, an additional feature of the invention is that it may be made to be self contained, portable design, thereby lending to easy cleaning and transportation. Cleaning is further facilitated by inversion of the hand-shaped chamber much in the same manner as a glove may be pulled inside-out. After cleaning, the hand and fingers of the capsule can be reinserted into the interior ready for ordinary use.

Accordingly it is an object of the invention to provide a therapeutic device for use in applying a therapeutic regime to a body extremity, such as the hands or feet.

It is an additional object of the invention to provide a therapeutic device which incorporates a newtonian or non-newtonian liquid in which therapy may be conducted without direct contact between the liquid and the user.

It is another object of the invention to provide a therapeutic device which may be shaped like a glove, which may be filled with a newtonian or non-newtonian liquid and into which a user may insert his or her hand.

It is a further object of the invention to provide a therapeutic device which may take advantage of simultaneous therapeutic agents.

It is still an additional object of the invention to provide a therapeutic device which through which the user can observe the action and motion of the body part under therapy.

It is still another object of the invention to provide a therapeutic device which significantly reduces the friction generated between body parts undergoing therapy when those body parts move in relation to each other.

It is still a further object of the invention to provide a therapeutic device in which the temperature of the device may be controlled without the need for the user to take the additional steps of first removing and then reinserting into the device the body part undergoing treatment.

Still other objects and advantages of the invention will, in part, be obvious and will, in part, be apparent from the specification.

The invention accordingly comprises the features of construction, combinations of elements and arrangements of parts which will be exemplified in the detailed descriptions hereinafter set forth, while the scope of the invention will be indicated in the claims.

BRIEF DESCRIPTION OF THE DRAWINGS

For a fuller understanding of the invention, reference is had to the following descriptions taken in connection with the accompanying drawings in which.

DETAILED DESCRIPTION OF THE INVENTION

Figure 1:
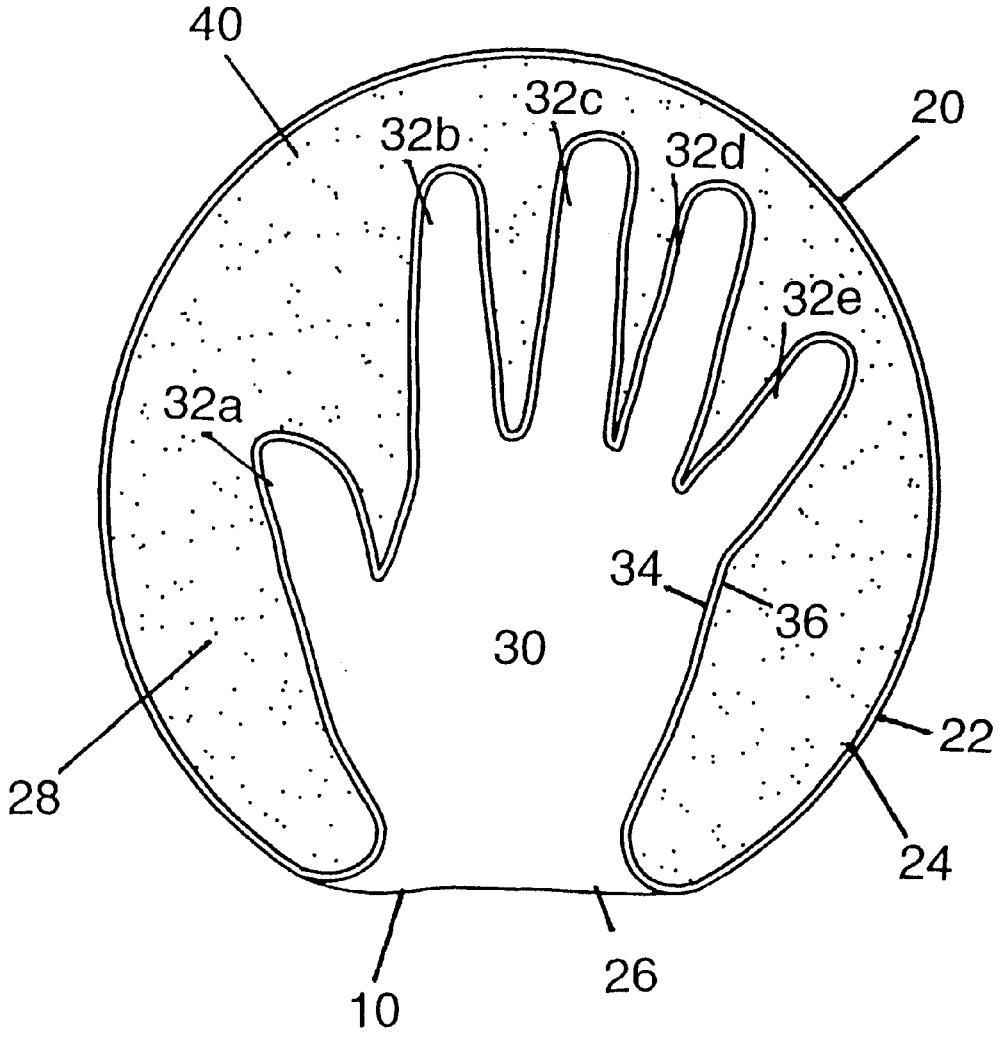
FIG. 1. is an illustration of an embodiment of the invention, configured for use in therapy to a hand, just prior to use.

Turning first to FIG. 1, as shown in it's preferred embodiment, the instant invention is referred to, generally as 10 and comprises a capsule 20 or chamber with an outer wall 22 and an inner wall 24. The configuration of the capsule 20 also defines an access end 26 which, in the preferred embodiment, allows a user to insert an extremity into the invention, 10. As illustrated, the capsule 20 illustrated is configured for providing therapy to a human hand and as such, incorporates a glove 30 including fingers 32*a–e*. In practice the glove 30 may be attached to the access end 26, or may form an integral one-piece construction in connection with capsule 20.

Continuing with FIG. 1, the capsule's interior 28 is filled, at least partially, with a viscous or visco-elastic fluid or gel 40, such as a liquid silicone. This fluid 40 may be a newtonian or non-newtonian liquid, and the capsule 20 itself is constructed, preferably, from a soft and pliable material, such as silicone rubber, which may fully contain the enclosed liquid while providing a barrier to direct contact between the liquid the extremity undergoing therapy. In construction, the capsule 20 is preferably seamless, though seams in it's construction which do not impact upon therapeutic function or effectiveness are acceptable. In addition, in construction, the chamber enclosing the liquid is constructed with surface dimensions sufficient such that the hand and digits, or other parts undergoing therapy, are able to be extended, contracted and otherwise permitted to move as far as possible in any direction and orientation without encountering the inner walls of the capsule 24 or other elements of the capsule's construction. An exception to this last condition may be found in the case where foreign objects are placed within the capsule to particular therapeutic effect, as will be discussed in the embodiments disclosed below.

Figure 2:
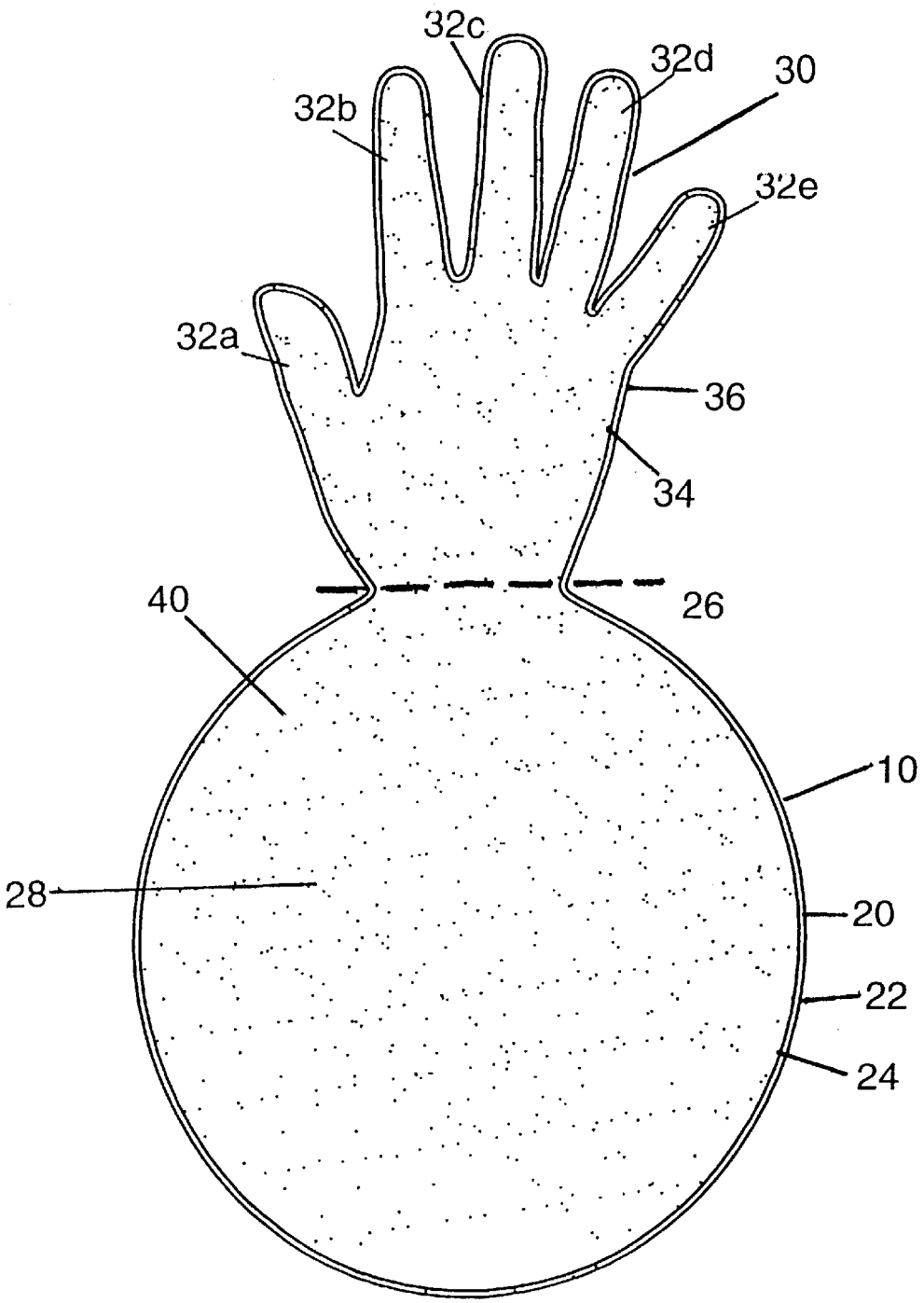
FIG. 2. is an illustration of the embodiment of the invention shown in FIG. 1, wherein the glove portion has been un-inverted.

Turning next to FIG. 2, a therapeutic device constructed in accordance with the instant invention, is shown at a stage prior to use or during a cleaning period. As can be seen, in it's un-inverted form, the invention resembles something of a bladder or balloon with a large area defined at one end, and a configuration approximating the shape and size of the extremity to be treated, at the other. The balloon shaped area is, in fact, the capsule 20 while the configuration approximating the shape of the area to be treated is the glove 30 which has been inverted so that the glove's interior surface 34 is now at least generally contiguous with the capsule's outer wall 22. Once the device has been manufactured, or after cleaning, pressure may be applied to the area adjacent to the capsule access end 26 so that, for example the glove end 30, may be re-inverted and relocated back into the capsule interior 38, such that the glove exterior surface 36 is once again located within the fluid 40 and spaced apart from the capsule inner wall 24.

As discussed above, the capsule interior 28 may be filled with either a Newtonian or non-Newtonian fluid 40. One suggested fluid is liquid silicone, of the medical grade variety. Silicone has a number of advantages, including the characteristic of being transparent. In physical therapy, and especially in connection with physical therapy for hands which have been subject fragile or delicate injuries or conditions, it is often useful to be able to view the user's hand directly as it enters or is withdrawn from a therapeutic device, and during its movement in therapy or exercise. Direct visual supervision of exercise regimens by the user, or by a medical or other trained supervisor can often be invaluable, and through the use of a clear or translucent device and a clear or translucent liquid very subtle and complex movements of the hand can be viewed directly, resulting in greater efficacy and/or safety in the case of particularly delicate injuries or conditions. In addition, through the use of a therapeutic device through which the user can see his or her hand, or other extremity, a psychological benefit is provided since the user is able to monitor his or her own progress toward recovery or relaxation. The psychological aspects of such feedback have been shown to be quite important, and may increase the tendency to engage in therapy without much prompting from supervisors or medical personnel.

Returning to the use of silicone, another advantage of it's use as a filling material is that it can be made electrically conductive using certain additives and surface coatings. This electrical conductivity allows the possibility of subjecting the user's hand to electro-stimulation therapy while still inside the hand-shaped indentation. In one embodiment electro-stimulation equipment may be attached directly to the outside of the capsule to deliver the appropriate stimulation through the liquid to the user's hand. Alternatively, small electrical connections, if thin enough, may be attached directly to the hand so that the hand may be immersed in the device along with the electrical connections without impeding movement of the hand and digits.

An additional desirable characteristic of using silicone, or other organic polymer gel or liquid, as a filling material are their exhibition of low frictional resistance. As can be understood, when any two items move against, across or even in harmony with each other, patterns of resistance may be set up. Such resistance may be found between the hand and the surface of the invention; the surface of the invention and the contained liquid; and the movement of one or more digits in relation to each other. By using a silicone or another organic polymer gel or liquid as a filling material, the interface between the capsule walls of the device and the silicone or polymer liquid contained within results in the ability to provide excellent lubrication between the digits when they are introduced into the indentation. This lubrication is highly desirable, since, in addition to the fluid resistance experienced in exercise, in this embodiment the digits are allowed to glide easily past one another and yet still experience the fluid resistance of the liquid without having to come into direct contact with the liquid itself.

Returning to the construction of the invention, in order to accommodate the greatest percentage of the population, it is desirable that the assembly be manufactured in a range of sizes and shapes in order to fit varying hand shapes and descriptions. Using modern computer controlled modeling and manufacturing techniques, it is anticipated that models of the invention may also be custom designed for specific applications or specific users in which the hand shape is nonstandard.

Considering other variations in the construction parameters of the instant invention, it is also understood that the viscosity and elasticity of the liquid within the capsule may be chosen from varying standards and for various applications. By way of example, certain types of hand injuries or disorders may require different degrees of viscous or visco-elastic resistance to hand and digit movement during exercise, and in such application the composition of the silicone or organic polymer liquid within may be varied accordingly. Alternatively, a multiplicity of standardized, or averaged, models could be manufactured in an effort to provide access to the invention to a wider range of users without increased cost.

In exploring further modifications to the invention, it is proposed that the exact composition of the capsule and liquid contained therein may vary. For example it is possible to add a detergent component to the liquid contained inside the capsule to facilitate easy washing of the hand should a rupture accidentally occur in the capsule wall. The color of the liquid filling and capsule wall could also be varied using additives in ways that could relate to size, right or left handedness, viscosity, elasticity, temperature, age and so on.

In addition, it is anticipated that the size and shape of the assembly may be made such as to permit easy portability and handling while the overall material and design simplicity can be selected to allow products made in accordance with the invention to be relatively inexpensive to fabricate and distribute.

It is noted at this point that although, in general, description of the preferred embodiment of the invention is directed to a device designed for providing hand therapy, in an alternative embodiment the viscous or visco-elastic silicone or organic polymer liquid filled silicone or organic polymer rubber capsule may be constructed with an indentation in its surface in the shape of another bodily extremities such as the foot. Such embodiment would be similar to the preferred embodiment in all respects except shape.

Figure 3:
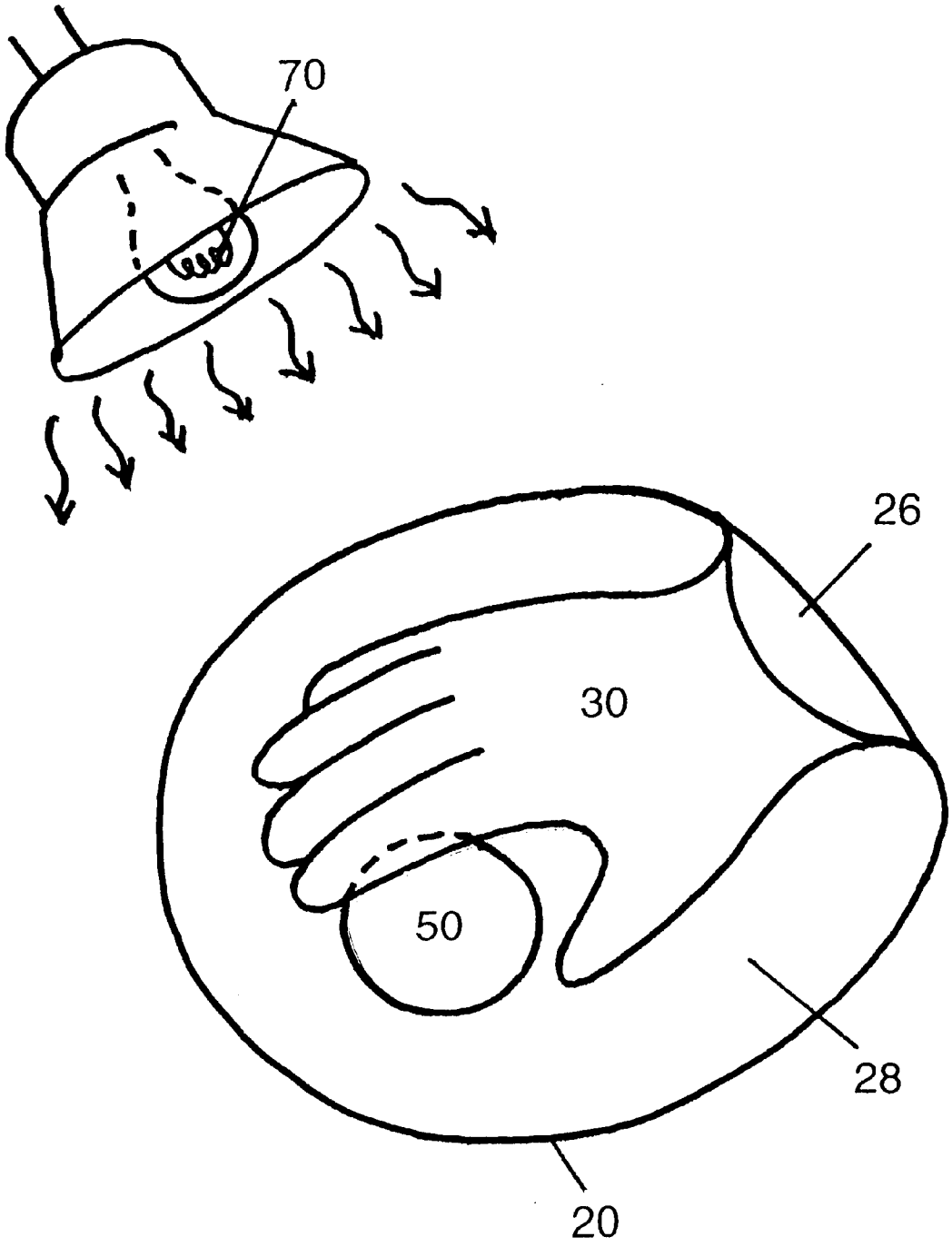
FIG. 3. is an illustration of an alternative embodiment of the invention as shown in FIG. 1.

Turning next to FIG. 3, an alternative embodiment of the invention is disclosed. As noted above, in the preferred configuration of the invention, a capsule 20 is provided which contains a Newtonian or non-Newtonian fluid 40 within which an extremity, such as a hand, can undergo therapeutic exercises without encountering the limitations of the prior art. However, in some instances an alternative internal configuration of the capsule may be desirable.

For example, in one modification to the invention additional partitions, valves, baffles or flow-controls (not shown) may be placed within the interior of the capsule to more precisely and particularly control the movement of the liquid around the interior walls of the capsule supporting the extremity undergoing therapy. These partitions, valves, baffles and flow controls may be used to regulate the resistance to movement that the device will present to the hand or other bodily extremity or, for example, to vary the resistance presented to different digits.

Figure 4:
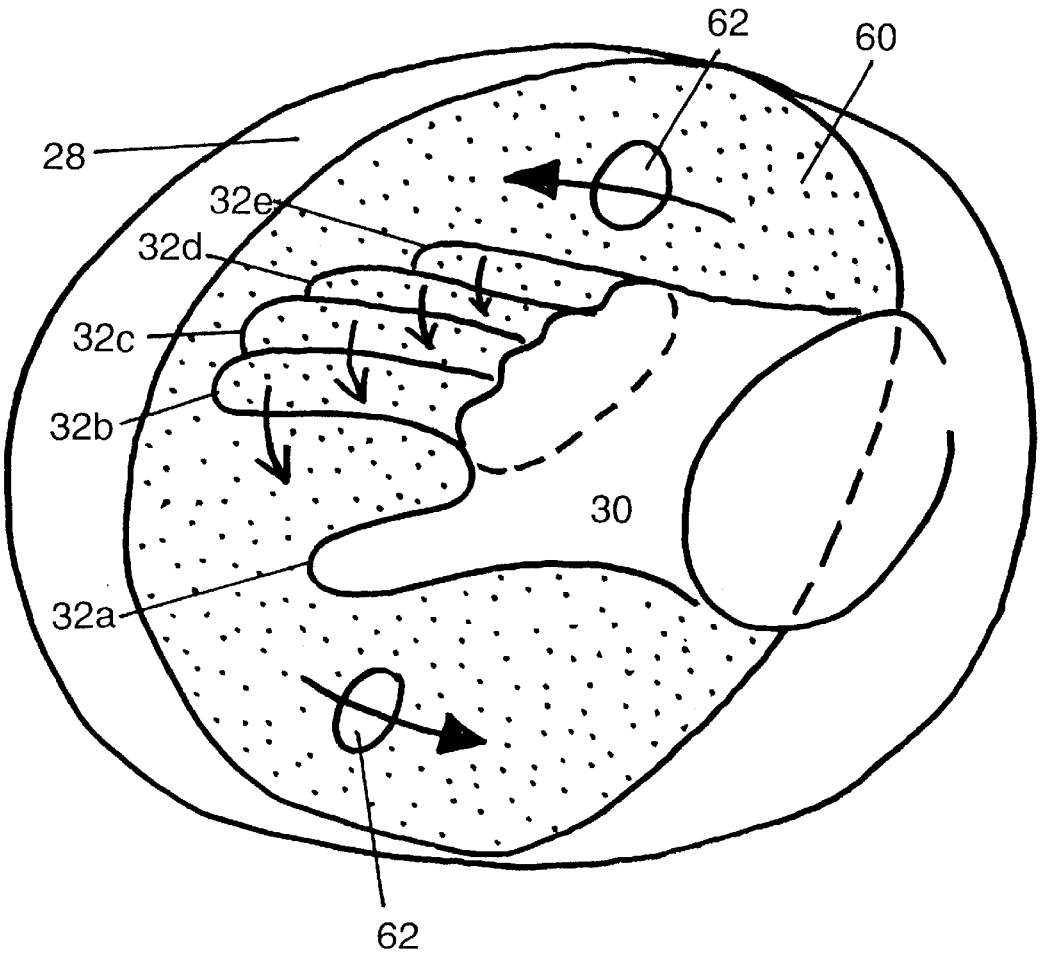
FIG. 4. is an illustration of a second alternative embodiment of the invention as shown in FIG. 1.

An example of such construction incorporating a baffle may be see in FIG. 4. As shown, a baffle 60 is located within the capsule interior 28 and is positioned so as to permit the fingers 32 of glove 30 to extend through the surface of the baffle. A perforation 62 is located in the surface of baffle 60 in order to permit fluid 40 to flow through the baffle 60, but at a restricted rate, thereby regulating the resistance to movement that the invention presents to the hand undergoing therapy.

In another modification to the invention, the thickness of the capsule wall may vary at different points across its surface in order to achieve different flexibilities in different parts of the device. The surface may also be ribbed or dimpled, or otherwise textured in certain areas to control flexibility, handleability, and strength. In addition hooks, loops, or other surface modifications may also be added for hanging, storage and handling purposes.

In yet an additional embodiment of the invention, free-floating objects may placed within the liquid in the interior of the capsule. These objects can be used to provide additional therapeutic elements against which the hand or other bodily extremities can work in therapy or exercise. For example, as shown in FIG. 3, an air or liquid filled silicone or organic polymer rubber ball 50 may be located within the capsule interior 28 in order to allow a hand undergoing therapy to engage in grasping exercises.

Also shown in FIG. 3, is a heat source 70. As noted earlier, the temperature of the hand undergoing treatment can be controlled by the use of radiant heating generated by an external means such as infrared radiation source 70, if such temperature control is required while the hand is still inside the device. Using this configuration allows the user to enjoy the benefits of physical therapy for longer periods without the need to occasionally remove his or her hand while the device is reheated.

Turning next to a discussion regarding methods for manufacturing the instant invention, three preferred alternatives are provided.

Using the first method, the flexible capsule may be fabricated using an injection molding process, similar to those currently in use by the medical implant industry, wherein the liquid filling is injected into the capsule prior to sealing the capsule.

Using the second method, the liquid may be cured within a mold with the result that the molding process may be used to generate the rubberized capsule from the liquid itself.

Finally, using the third method, the capsule may be produced by dipping a mold into curable material which , when cured, could be stripped from the mold, filled with liquid, sealed and then inverted ready to receive the hand.

Under any of these methods, variations in the viscosity, composition, amount and pressure of the liquid contained in the capsule may be made in order to affect the specific utility of the product. In addition, the flexibility, composition and thickness of the capsule wall may be controlled in the molding process while those additional objects and components such as valves or air filled balls desired to be located within the capsule chamber may be introduced into the liquid interior before sealing of the capsule. Finally, it is noted that using the disclosed manufacturing techniques, it may be preferable to mold the shape in its outward configuration (as shown in FIG. 2) and then insert the indentation to its inward configuration (as shown in FIG. 1) ready for use.

Accordingly, by using the disclosed structure and construction, a flexible capsule, anatomically shaped in such a way that a person may introduce his or her hand (or other bodily extremity) into the assembly, is provided for use in a therapeutic or exercise environment. The capsule is at least partially filled with a Newtonian or non-Newtonian liquid, and the capsule is shaped in such a way that once inside, the hand and fingers may all move relatively freely subject to the viscous or visco-elastic resistance provided by the liquid and by the layer of flexible capsule material interposed between the hand and the liquid. The capsule material, which may be composed of one or more layers, protects the hand from direct contact with the liquid contents. By using such construction, a therapeutic device may be provided within which many types of gentle exercise and stimulation for body extremities may be provided, and which is easy to use, may be reused, may provide a comfortable, safe, washable, portable, stimulating and restorative environment for physical therapy or relaxation, and which may permit the simultaneous use of multiple therapeutic agents (exercise, thermal stimulation, light therapy, ultrasound therapy, electro-stimulation, and clear visibility).

Accordingly, it will thus be seen that the objects set forth above, among those made apparent from the preceding description are efficiently attained and, since certain changes may be made in the above constructions without departing from the spirit and scope of the invention, it is intended that all of the matter contained in the above description or shown in the accompanying drawings, shall be interpreted as illustrative, and not as limiting.

It will also be understood that the following claims are intended to cover all of the generic and specific features of the invention, herein described, and all statements of the scope of the invention which, as a matter of language, might be said to fall there between.

What is claimed is:

1. A therapeutic device for providing therapy to a pre-selected portion of a body, said therapeutic device comprising:

a resilient outer surface, said outer surface defining an enclosed area;

a liquid, said liquid being completely enclosed by said outer surface, said liquid further being both non-newtonian and viscoelastic, such that the rheology of said liquid is precisely controlled so that the liquid exhibits lower viscosity-dominated resistance to movement when movement through the liquid is slower and the liquid exhibits higher elastic resistance to movement when movement through the liquid is faster; and an inner chamber formed by inverting at least a portion of said outer surface to create a depression, said depression having dimensions being the approximate size and shape of the pre-selected portion of a body to which therapy is to be provided.

2. The therapeutic device, as claimed in claim 1, wherein said liquid is a silicone gel.

3. The therapeutic device, as claimed in claim 1, wherein said outer surface is transparent, permitting observation of the selected portion of the body to which therapy is to be provided.

4. The therapeutic device, as claimed in claim 1, further comprising a temperature control mechanism for controlling the temperature of said liquid.

5. The therapeutic device, as claimed in claim 1, wherein said outer surface defines a physical configuration, said physical configuration having dimensions such that when said inner chamber is formed by inverting at least a portion of said outer chamber, said liquid is disposed within said outer surface such that it surrounds said selected portion of said body to which therapy is to be provided when the selected portion of a body to which therapy is to be provided is inserted into said inner chamber.

6. The therapeutic device, as claimed in claim 1, wherein said outer surface is formed through a molding process.

7. The therapeutic device, as claimed in claim 1, wherein said outer surface is formed through a dispersion dipping and curing process.

8. The therapeutic device, as claimed in claim 1, further comprising at least one baffle located within the enclosed area defined by said outer surface, said at least one baffle being positioned such that when said inner chamber is formed by inverting at least a portion of said outer surface, and a selected portion of a body to which therapy is to be provided is inserted into said chamber and moved, movement of said selected portion of said body to which therapy is to be provided will cause said liquid to flow within said outer surface and said baffle will affect the flow of said liquid around said selected portion of said body to which therapy is to be provided.

9. The therapeutic device, as claimed in claim 1, further comprising an exercise object, said exercise object being located within the enclosed area defined by said outer surface such that the body part undergoing therapy is able to incorporate the exercise object into a therapeutic regime.

10. The therapeutic device, as claimed in claim 9, wherein said exercise object is a ball.

11. The therapeutic device, as claimed in claim 1, wherein the process of forming said inner chamber by inverting at least a portion of said outer surface is reversible for the purpose of cleaning said therapeutic device.

12. The device for providing therapy to a hand, as claimed in claim 11, wherein said capsule comprises a shape which includes an area substantially in the shape of a human hand, and wherein said therapy glove is formed by inverting said area substantially in the shape of a human hand so that it is located within the area defined by said inner surface of said capsule.

13. The device for providing therapy to a hand, as claimed in claim 11, wherein said liquid comprises silicone.

14. The device for providing therapy to a hand, as claimed in claim 11, wherein said capsule is formed from at least a partially transparent material.

15. The device for providing therapy to a hand, as claimed in claim 11, further comprising an exercise object, said exercise object being located within the area defined by said inner surface such that when a hand undergoing therapy is placed within said therapy glove, said hand may hold said exercise object with said therapy glove.

16. A device for providing therapy to a hand, said device comprising:

a resilient capsule, said capsule defining the outside dimensions of said device, said capsule having an outer surface and an inner surface;

a liquid, said liquid being located within and substantially filling an area defined by the inner surface of said capsule, said liquid being both non-newtonian and viscoelastic, said liquid being selected such that the rheology of said liquid is precisely controlled so that the liquid exhibits lower viscosity-dominated resistance to movement when movement through the liquid is slower and the liquid exhibits higher elastic resistance to movement when movement through the liquid is faster; and a therapy glove, said therapy glove being positioned within the area defined by said inner surface of said capsule without breaching the integrity of said outer surface of said capsule.

* * * * *